US007946087B1

(12) United States Patent
Seitzinger

(10) Patent No.: US 7,946,087 B1
(45) Date of Patent: May 24, 2011

(54) ROOF DRAIN SUMP BOX

(76) Inventor: James B. Seitzinger, Lake Forest, CA (US)

( * ) Notice: Subject to any disclaimer, the term of this patent is extended or adjusted under 35 U.S.C. 154(b) by 149 days.

(21) Appl. No.: 12/387,942

(22) Filed: May 11, 2009

Related U.S. Application Data

(60) Provisional application No. 61/127,987, filed on May 19, 2008.

(51) Int. Cl.

| | |
|---|---|
| ***E04B 1/70*** | (2006.01) |
| ***E04B 1/66*** | (2006.01) |
| ***E04B 7/00*** | (2006.01) |
| ***E04F 17/00*** | (2006.01) |

(52) U.S. Cl. ..... 52/302.1; 52/302.6; 52/302.7; 52/198; 52/199; 52/196

(58) Field of Classification Search ..... 52/302.1, 52/302.6, 302.7, 198, 199, 196, 197, 219, 52/220.8, 746.11; 210/163, 164, 166
See application file for complete search history.

(56) References Cited

U.S. PATENT DOCUMENTS

| | | | | | |
|---|---|---|---|---|---|
| 1,690,630 | A | * | 11/1928 | Fleming | 210/166 |
| 3,469,698 | A | * | 9/1969 | Blendermann | 210/163 |
| 3,517,813 | A | * | 6/1970 | Thaler | 210/166 |
| 4,487,690 | A | | 12/1984 | Logsdon | |
| 4,492,491 | A | * | 1/1985 | Lunden et al. | 405/119 |
| 4,505,814 | A | * | 3/1985 | Marshall | 210/166 |
| 4,943,100 | A | | 7/1990 | Emberson | |
| 5,051,175 | A | | 9/1991 | Walczak et al. | |
| 5,378,356 | A | * | 1/1995 | Logsdon | 210/163 |
| 5,618,416 | A | | 4/1997 | Haefner | |
| 5,689,928 | A | | 11/1997 | Rasksen | |
| 5,724,777 | A | | 3/1998 | Hubbard | |
| 5,966,884 | A | * | 10/1999 | Uglow | 52/302.1 |
| 6,185,889 | B1 | | 2/2001 | Gilgan et al. | |
| 6,269,495 | B1 | * | 8/2001 | Sondrup | 4/679 |
| 6,755,966 | B1 | * | 6/2004 | Reed | 210/164 |
| 6,953,208 | B2 | | 10/2005 | Warnecke | |
| 7,484,506 | B2 | | 2/2009 | Besal | |
| 7,614,198 | B1 | * | 11/2009 | Piskula et al. | 52/741.1 |
| 2003/0037498 | A1 | * | 2/2003 | Bishop | 52/302.1 |
| 2003/0141231 | A1 | * | 7/2003 | Rattenbury et al. | 210/163 |
| 2004/0200162 | A1 | * | 10/2004 | Wroblewski | 52/302.1 |
| 2005/0166315 | A1 | * | 8/2005 | Warnecke et al. | 4/695 |

* cited by examiner

*Primary Examiner* — Basil Katcheves
*Assistant Examiner* — Mark R Wendell
(74) *Attorney, Agent, or Firm* — Gordon K. Anderson

(57) ABSTRACT

A roof drain sump box (10) is utilized for positioning a roof drain (12) on a flat roof. The sump box is formed with a horizontally oriented flat plate (20) with a central opening (22) making a peripheral flange (24). The central opening has a width less than a distance between building roof joists providing attachment of the sump box onto the flat roof top of a building without altering the building structure. An angular transition portion (46) is integrally formed with the flange contiguous with the central opening. A vertically oriented downwardly depending step (48) is formed integrally with the angular transition portion and a horizontally oriented flat sump deck (50) is integrally formed with the step. The sump deck, is coplanar with the flange, and incorporates a roof drain opening (52) to receive the roof drain (12). The sump deck is positioned sufficiently below the flat plate permitting water to flow uninhibited into the roof drain without ponding.

3 Claims, 3 Drawing Sheets

ROOF DRAIN SUMP BOX

CROSS REFERENCE TO RELATED APPLICATION

This application claims priority of Provisional Patent Application No. 61/127,987 filed May 19, 2008.

TECHNICAL FIELD

The present invention relates to flat roof drain attachment apparatus in general. More specifically to a sump box adapted to mount a dome outlet roof drain permitting the drain to be positioned beneath the level of the roof for optimum drainage.

BACKGROUND ART

Previously, many types of roof drain arrangements and support plates have been used in endeavoring to provide an effective means to mount and secure a drain assembly on a flat building roof.

A search of the prior art did not disclose any patents that possess the novelty of the instant invention; however the following U.S. patents are considered related:

| Pat. No. | Inventor | Issue Date |
|---|---|---|
| 4,487,690 | Logsdon | Dec. 11, 1984 |
| 4,943,100 | Emberson | Jul. 24, 1990 |
| 5,051,175 | Walczak et al. | Sep. 24, 1991 |
| 5,618,416 | Haefner | Apr. 8, 1997 |
| 5,689,928 | Rasksen | Nov. 25, 1997 |
| 5,724,777 | Hubbard | Mar. 10, 1998 |
| 6,185,889 B1 | Gilgan et al. | Feb. 13, 2001 |
| 6,953,208 B2 | Warnecke | Oct. 11, 2005 |
| 7,484,506 B2 | Besal | Feb. 3, 2009 |

Logsdon in U.S. Pat. No. 4,487,690 teaches a roof drain for either a sump or a flush installation which incorporates a body having a centrally located water collecting section capable of attachment to a pipe. A first and a second surface are parallel to one another with the first surface mounting to the roof and the second surface is a sump with an insert fitting against the connecting surfaces located between the grate and the body.

U.S. Pat. No. 5,618,416 issued to Haefner is for a roof drain including a grated, inverted, frusto-conically shaped cover received in a roofing material clamp having a radial, upstanding debris discouraging flange. The cover and roof material clamp are demountably fixed to a flanged drain body and clampingly maintain roof material therebetween. The drain body is received by a flanged sleeve. The drain body and sleeve flanges clampingly maintain roof substrate therebetween by the use of a nut threadingly intergaging with threads on the drain body which urges the sleeve toward the roof substrate.

Rasksen in U.S. Pat. No. 5,689,928 discloses a roof drain for draining rain water from a flat roof having a conduit with a roof flange, a strainer and an opening cap, for eliminating debris. The roof flange extends peripherally outwardly around the top of the conduit and provides a connection between the surfaces of the roof. The conduit provides a connection with a drainage pipe located beneath the surface of the roof. The roof flange has a flat outer top surface and a recessed inner portion with a shoulder connecting the inner an outer portions of the roof flange. The strainer includes a hollow strainer basket with open bottom and top faces and side walls containing a plurality of apertures and a strainer flange extending peripherally outwardly around the bottom edge of the side walls of the strainer basket. The outside dimension of the strainer flange is sized to fit within the recessed portion of the roof flange.

Hubbard in U.S. Pat. No. 5,724,777 teaches a roof drain arrangement and method for sealing a space between an existing drain opening, the roof drain and a new roof membrane. The arrangement and method provide sealing an area between the roof drain and roof structure. Sealing is provided by adhesive material disposed on a lower surface of an upper flange portion of the insert portion or by adhesive on an upper surface of a base plate. This sealing may also be provided by a roofing membrane located between the lower surface of the upper flange and the base plate or a combination thereof.

U.S. Pat. No. 6,185,889 B1 issued to Gilgan et al. is for a flat roof drainage system which utilizes a low point column head which allows the roof to be drained at the center of a structural member located at the low point of the roof. The low point column head is a structural extension of a building column and is adapted to permit the attachment of support beams at the column as well as the placement of a roof drain at the center of the column head such that the roof drain may be located directly at the lowest area of the roof thus eliminating standing water.

Warnecke in U.S. Pat. No. 6,953,208 B2 discloses a drain support plate adapted to fasten to a receptacle body of a drain. A first end of the receptacle body includes at least one protrusion extending away from the receptacle body and a second end of the body fastens to a drain pipe. The drain support plate includes a body having a first portion, an intermediate portion and a second portion. The first portion has a plurality of elongated slots adapted to receive fasteners for securing the support plate to the deck. The second portion of the body also defines at least one slot to receive a member of attaching the body to the support plate. A distance between the first portion and the second portion is sufficient for the second portion to support the receptacle body. Further the slot in the second portion is adapted to be aligned with the receptacle body for receiving a member for attaching the receptacle body to the body of the support plate.

For background purposes and as indicative of the art to which the invention is related reference may be made to the remaining cited patents issued to Emberson U.S. Pat. No. 4,943,100, Walczak et al. U.S. Pat. No. 5,051,175 and Besal U.S. Pat. No. 7,484,506 B2.

DISCLOSURE OF THE INVENTION

Flat roofs built in countries throughout the world must have some means of draining the roof surface of rainwater otherwise the roof could crack and rupture or even collapse under the weight of the accumulated water. In order to prevent this damage from occurring, government agencies have developed plumbing codes and the industry has provided their own guidelines that outline methods and apparatus that transfer the rainwater directly to the ground level. Even with the regulations and guidelines, problems may still exist in many instances as various types of roof drains are on the market and several manufacturing firms specialize in this type of product however the method of attachment and location still allows room for improvement.

It is therefore the primary object of the invention to solve a long felt need by providing a sump box that positions the roof drain below the horizontal surface of the roof instead of directly on the same level as the rainwater. Since most roof drains are designed to mount on the upper surface of the roof a flashing cap and gravel guard are supplied, in order to provide the necessary protection however, this device is positioned slightly above the surface of the roof allowing a small amount of rainwater to be trapped on the flat roof before entering the roof drain. The instant invention provides a sump box for installation that solves completely the problem of ponding around the roof drain.

An important object of the invention is the simplicity of the sump box as it is made of thin material which has a flange that only sits above the roof less than 1/16th of an inch which permits the rainwater to enter the box from all directions and flow easily into the drain.

Another object of the invention increases the efficiency of the roof drain as gravity is utilized to quickly remove the rainwater by eliminating any obstructions and supplying a smooth transition from the roof itself directly into the drain.

Still another object of the invention allows plumbers or roofers an easy means to lower an existing roof drain. Many flat roofs settle over the years therefore the roof may become lower than where the roof drain was originally installed requiring the existing roof drain to be lowered. This rework is a cumbersome and expensive task requiring the roofer or plumber to build a box usually out of wood necessitating extensive labor. The invention only requires cutting a hole between the roof joists and attaching the flange of the prefabricated sump box to the roof utilizing nails positioned through existing peripheral holes. The roof drain is easily installed in the sump deck within the preformed opening complete with slots and mating notches.

Yet another object of the invention is in the design of the sump box which permits mounting in roofs that are constructed of roof joists that are space apart on standard 16 inch centers. The same utility is afforded with buildings that have the joists that are located on wider 24 inch centers.

A further object of the invention eliminates the need to rework "in the wall scupper drains" to comply with some government code requirements.

An additional feature permits the use of side or bottom outlet roof drains that are commonly used, readily available and well known in the art.

A final object of the invention is the ease of changing the base material of the sump box at the time of manufacture for use in special applications.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
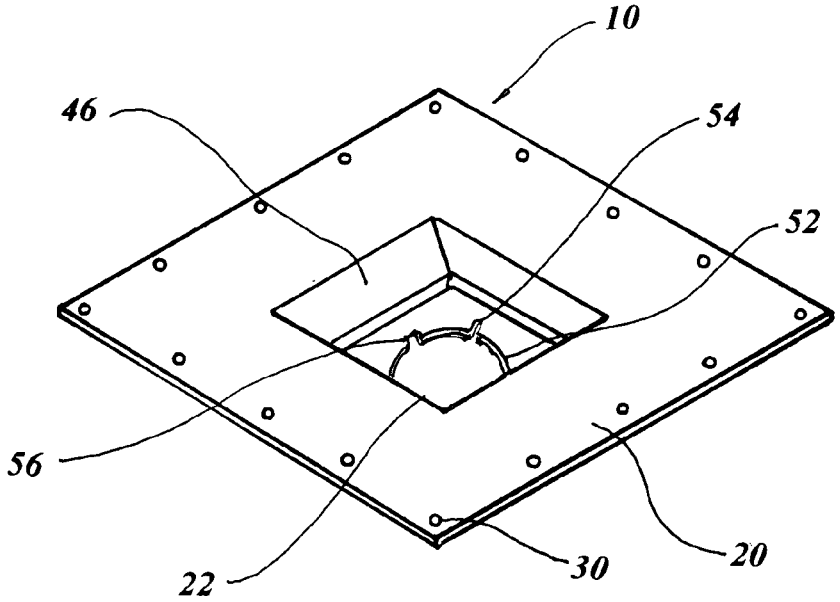
FIG. 1 is a partial isometric view of the roof drain sump box in the preferred embodiment.

The best mode for carrying out the invention is presented in terms of a preferred embodiment and also a second embodiment which varies only in the construction practice. The preferred embodiment of a roof drain sump box 10 is shown in FIGS. 1 thorough 13 and is comprised of a horizontally oriented flat plate 20, fabricated integrally from a single sheet of material, having a central opening 22 therein forming a peripheral flange 24 around the opening. The central opening 22 preferably has a width which is less than a distance between building roof joists 26, which, at least in the United States is the industry standard, either 16 inches or 24 inches apart center to center.

Figure 2:
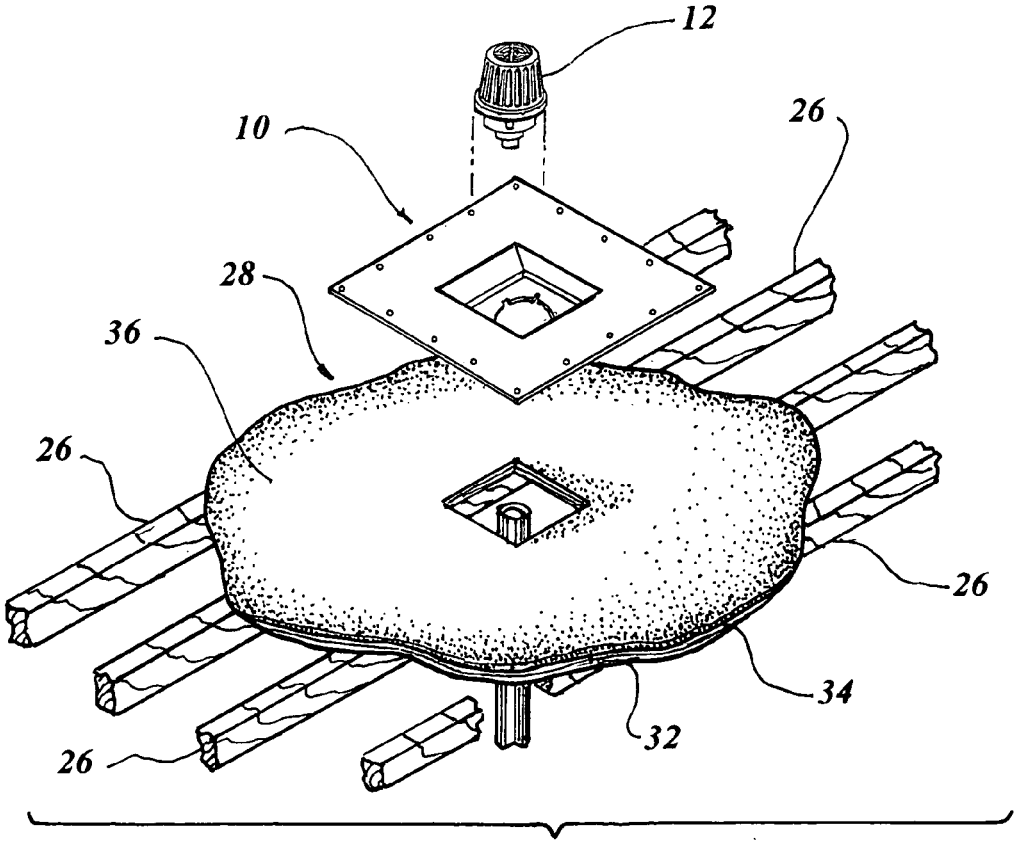
FIG. 2 is an exploded view of the preferred embodiment illustrating the manner in which the sump box is installed on a building flat roof.
Figure 3:
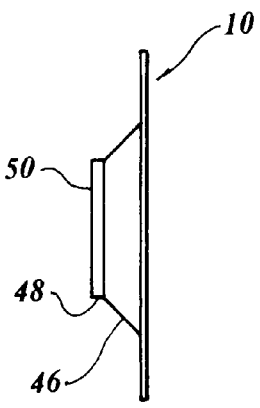
FIG. 3 is a left side view of the roof drain sump box in the preferred embodiment.
Figure 4:
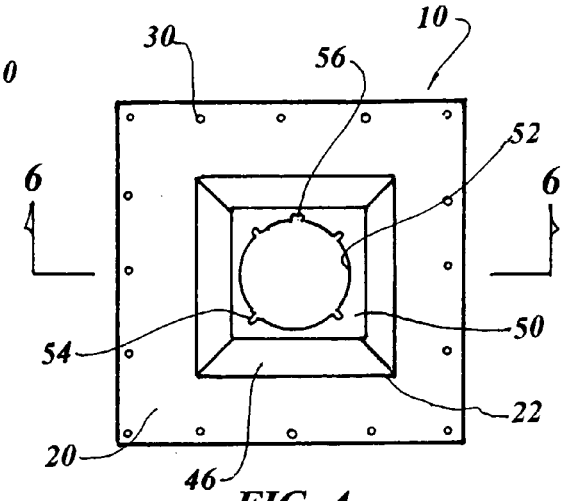
FIG. 4 is an elevation plan view of the roof drain sump box in the preferred embodiment.
Figure 5:
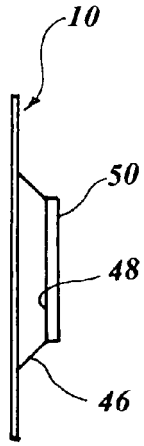
FIG. 5 is a right side view of the roof drain sump box in the preferred embodiment.
Figure 7:
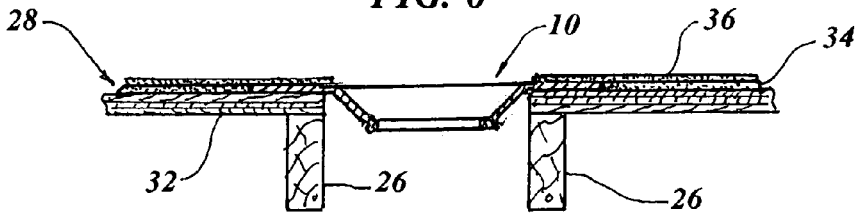
FIG. 7 is an arbitrary cross sectional view of the roof drain sump box in the preferred embodiment installed on a typical flat roof of a building.
Figure 8:
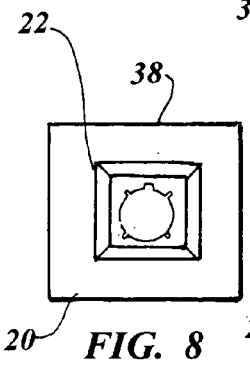
FIG. 8 is an elevation plan view of the roof drain sump box with the flat plate having a central opening in the square configuration.
Figure 9:
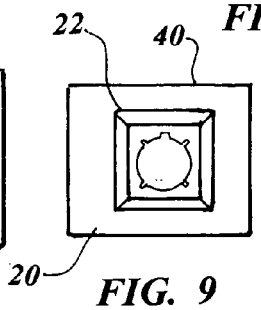
FIG. 9 is an elevation plan view of the roof drain sump box with the flat plate having a central opening in the rectangular configuration.
Figure 10:
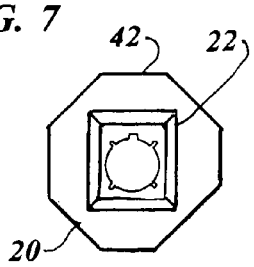
FIG. 10 is an elevation plan view of the roof drain sump box with the flat plate having a central opening in the polygonal configuration.

The peripheral flange 24 provides for attachment of the sump box 10 to a building flat roof 28, as illustrated in FIGS. 2 and 7. The peripheral flange 24 preferably has a width of at least 6.00 inches (15.24 centimeters) which meets most government building codes. The flange 24 may optionally incorporate a series of mounting holes 30 at least 0.50 inch (1.27 centimeter) from an outside edge toward the central opening spaced apart on approximately 6.00 inch (15.24 centimeter) centers. These mounting holes 30, as shown in FIGS. 1, 2 and 4, allow the installer to insert nails through the holes 30 without the necessity of layout or the extra effort in nailing through the base material. FIGS. 8-11 illustrate configurations that do not have the holes 30 shown. FIGS. 2 and 7 illustrate a typical installation of the sump box 10 with the flange 24 resting directly on the plywood structure 32 supported by the roof joists 26. A primary roofing membrane 34 butts into the outer edge of the flange 24 and a secondary roofing membrane 36 is layered on top completely covering the sump box 10. FIG. 2 is a partial exploded view which depicts a typical commercially manufactured cast iron roof drain 12 above the box 10 which is not part of the invention.

Figure 11:
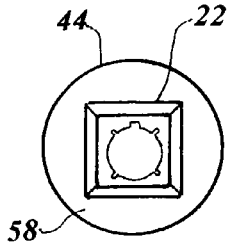
FIG. 11 is an elevation plan view of the roof drain sump box with the flat plate having a central opening in the round configuration.

The entire roof drain sump box 10 utilizes a material consisting of steel sheet metal or galvanized steel sheet metal, however other materials such as stainless steel sheet metal, aluminum, copper, lead, or brass are viable alternatives for specialized applications. The preferred material thickness is at least 0.048 inches (0.31 centimeters) or 24 gauge again other thickness may also be used with equal utility. The horizontally oriented flat plate 20 may have almost any peripheral configuration such as a square 38 illustrated in FIGS. 1-8, 14 and 15, a rectangle 40 shown in FIG. 9, a polygon 42 depicted in FIG. 10 or round 44 as represented in FIGS. 11-13.

A downwardly facing angular transition portion 46 is formed integrally with the peripheral flange 24 and contiguously engages the central opening 22. The angular transition portion 46 is preferably formed with an angular inward slope from 89 degrees to 40 degrees, with 45 degrees preferred, however a 90 degree right angle may also be a functional alternative.

Figure 12:
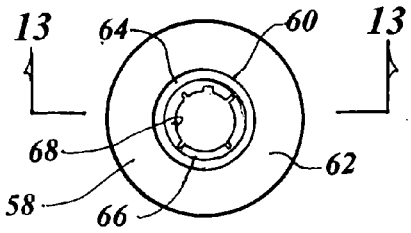
FIG. 12 is an elevation plan view of the roof drain sump box with the flat plate having a central opening in the round configuration with a round flat sump deck.
Figure 13:
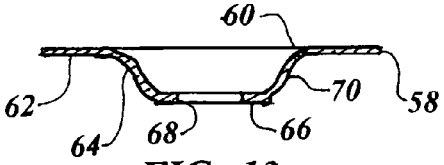
FIG. 13 is a cross sectional view taken along lines 13-13 of FIG. 12.

A vertically oriented downwardly depending step 48 is formed integrally with said angular transition in the preferred embodiment, however in some instances the step 48 may be eliminated with the sump box 10, as shown in FIGS. 12 and 13, still providing the same utility. The downwardly depending step 48 may have a vertical depth of at least 0.38 inch (0.96 centimeter) from the angular transition portion 46 which has proven ideal to accommodate a specific roof drain 12.

A horizontally oriented flat sump deck 50 is integrally formed with the downwardly depending step 48, as illustrated in FIGS. 3 and 5-7. The sump deck 50 basically incorporates a roof drain interface opening 52 that is adaptable to receive the roof drain 12. The sump deck 50 is required to be coplanar with the peripheral flange 24 with the sump deck 50 in a position located sufficiently below the flat plate 20 as to permit rainwater to flow uninhibited into the roof drain 12.

The roof drain interface opening 52 may included a number of roof drain slots 54 and at least one roof drain notch 56 to clear a boss in the roof drain 12 which provides an interface for mounting and securing the roof drain 12. The roof drain slots 54 and the at least one roof drain notch 56 are shown best in FIGS. 4 and 8-12.

Figure 6:
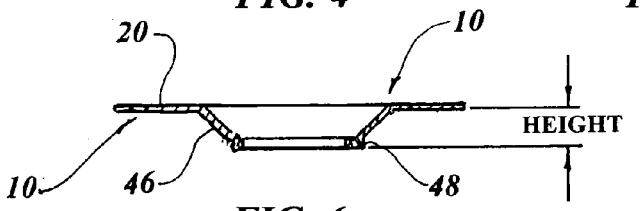
FIG. 6 is a cross sectional view taken along lines 6-6 of FIG. 4.

Of considerable importance is the location of the sump deck 50 which must be positioned below the flange 24 by at least 2.00 inches (5.08 centimeters) which allows rainwater to flow uninhibited into the roof drain 12. The 2.00 inch (5.08 centimeter) dimension is illustrated in FIG. 6 and is designated by the word "HEIGHT".

An alternate configuration of the roof drain sump box 10 is illustrated in FIGS. 12 and 13 which incorporate a horizontally oriented round flat plate 58 having a central opening 60 therein forming a round peripheral flange 62 surrounding the opening 60. A round radial transition member 64 is formed integrally with the round peripheral flange 62, and a horizontally oriented round flat sump deck 66 is integrally formed with the transition member 64. The sump deck 66 includes a drain interface opening 68 adaptable to receive the roof drain 12 and the round sump deck 66 is coplanar with the round peripheral flange 62. The transition member 64 and round flat sump deck 66 may have a reversed radial interface 70 therebetween preferably in an S-shape.

Optionally a vertically oriented downwardly depending step 72 may be formed integrally between the round transition 64 and the round flat sump deck 66 but is not specifically illustrated as it is basically the same as the preferred embodiment.

Figure 14:
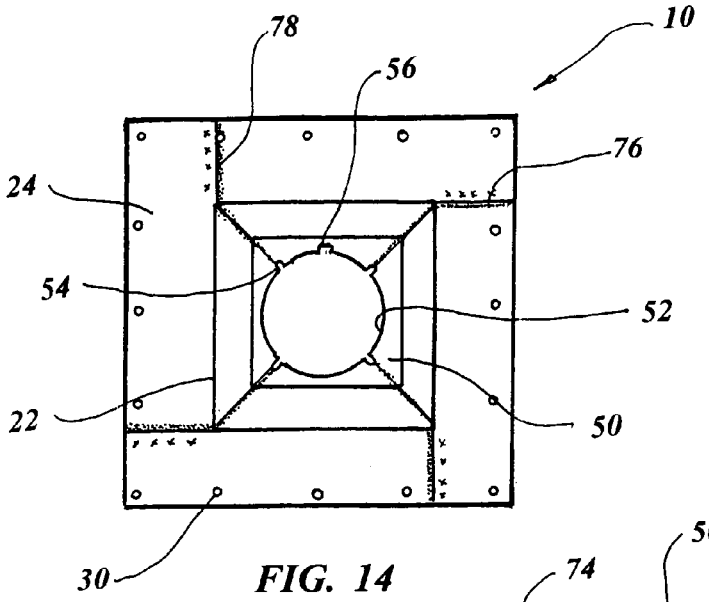
FIG. 14 is an elevation plan front view of the roof drain sump box with the flat plate having a central opening in the rectangular configuration formed in four discrete pieces.
Figure 15:
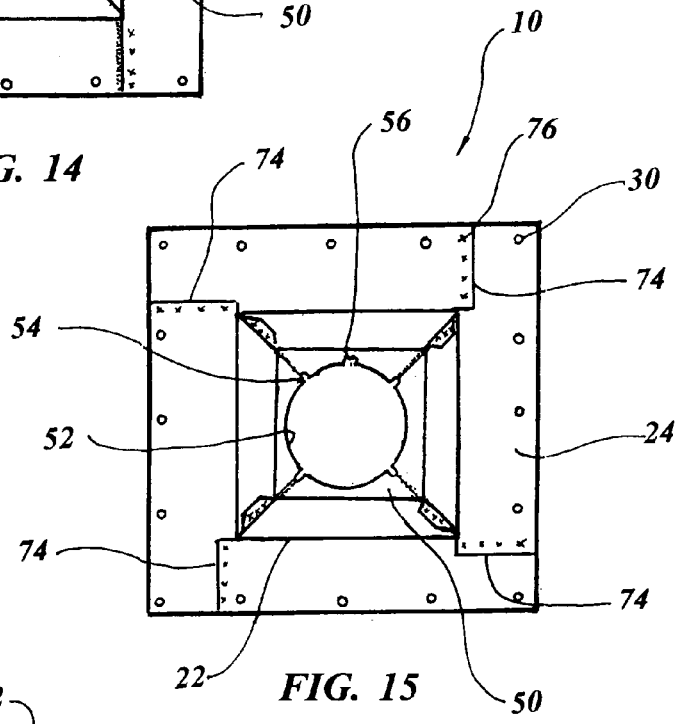
FIG. 15 is a rear view of the roof drain sump box with the flat plate having a central opening in the rectangular configuration formed in four discrete pieces.
Figure 16:
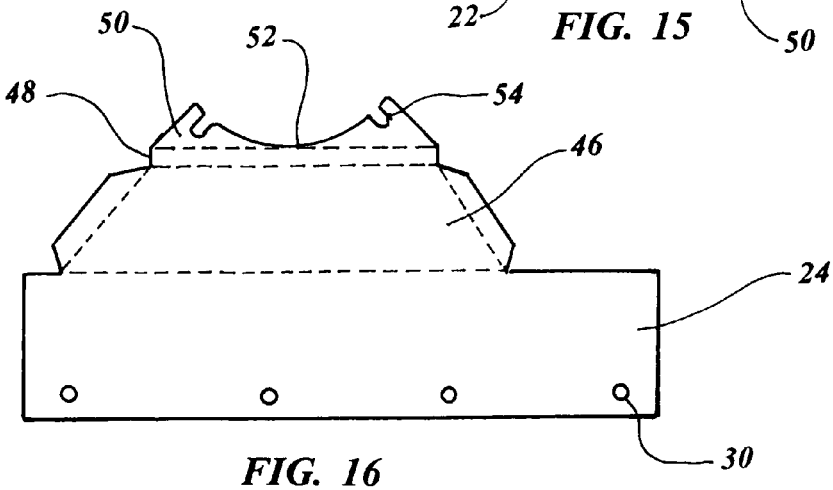
FIG. 16 is an outline pattern of a flat sheet of material making up one of the four discrete pieces of the sump box with break lines shown dashed.

The second embodiment of the roof drain sump box 10 is illustrated in FIGS. 14-16 and is basically the same as the preferred embodiment except the sump box 10 is formed in four discrete pieces having overlapping junctures 74 attached together. The overlapping junctures 74 incorporate of a number of spot welds 76 and solder joints 78, where the junctures 74 overlap to provide strength and are attached with the spot welds 76 and the soldering achieves a water tight joint of the complete sump box 10. FIG. 14 illustrates the front of the sump box 10 and FIG. 15 the rear with FIG. 16 showing the base material as laid out "in the flat" with bend lines depicted with dash lines. Where a raw edge is visible the gap therebetween contains a solder joint 78 as illustrated in FIGS. 14 and 15.

For installation of a new drain the procedures are as follows:

1. Cut a hole in the roof the size of the transition portion 46.
2. Drop in the box 10 with the flange 24 resting on the plywood roof.
3. Drive nails or screws in the mounting holes 30.
4. Drop in the roof drain 12 and attach with bolts provided.
5. Connect the plumbing beneath the sump deck 50.

For installation lowering an existing drain the procedures are as follows:

1. Disconnect plumbing and remove roof drain 12.
2. Cut a hole in the roof the size of the transition portion 46.
3. Drop in the box 10 with the flange 24 resting on the plywood roof.
4. Drive nails or screws in the mounting holes 30.
5. Drop in the roof drain 12 and attach with bolts provided.
6. Connect the plumbing beneath the sump deck 50.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A sump box for a roof drain which comprises;

a plurality of horizontally oriented flat plate portions overlapping each other having a central opening therebetween, with the flat plate portions defining a peripheral flange around said opening, with the central opening having a width less than a distance between building roof joists, with the peripheral flange providing attachment of the sump box to a building flat roof, a plurality of downwardly facing angular transition portions overlapping each other, integral with said peripheral flange contiguous with said central opening, a plurality of vertically oriented downwardly depending steps integral with said angular transition portion portions, and a plurality of horizontally oriented flat sump deck portions integral with said downwardly depending step portions, said sump deck portions having a roof drain interface opening adaptable to receive a roof drain with the sump deck portions coplanar with said peripheral flange, said sump deck portions positioned sufficiently below the flat plate portions permitting water to flow uninhibited into the roof drain, wherein said sump deck portions are positioned below said peripheral flange at least 2.00 inches (5.08 centimeters), wherein said each sump box is made from a material selected from the group consisting of steel sheet metal, galvanized steel sheet metal, stainless steel sheet metal, aluminum, copper, lead, and brass, with a thickness of at least 0.048 inches (0.31 centimeters) or 24 gauge, wherein said overlapping junctures are attached together with a plurality of spot welds and a plurality of solder joints at said junctures providing a water tight sump box.

2. The roof drain sump box as recited in claim 1 wherein said peripheral flange around said opening further comprises a width of at least 6.00 inches (15.24 centimeters).

3. The roof drain sump box as recited in claim 1 wherein said flat sump deck interface opening having a plurality of roof drain slots and at least one roof drain notch to clear a roof drain boss for interfacing with a roof drain.

* * * * *